United States Patent [19]

Kuchenbecker

[11] Patent Number: 4,577,762

[45] Date of Patent: Mar. 25, 1986

[54] RECLOSABLE PACKAGE AND CARTON BLANK AND PROCESS FOR MAKING THE SAME

[75] Inventor: Morris W. Kuchenbecker, Neenah, Wis.

[73] Assignee: James River Corporation of Virginia, Richmond, Va.

[21] Appl. No.: 749,886

[22] Filed: Jun. 27, 1985

[51] Int. Cl.[4] ..... B65D 5/54

[52] U.S. Cl. ..... 206/612; 206/626; 493/58; 493/59; 493/148

[58] Field of Search ..... 206/612, 625, 626, 629; 493/58, 59, 148

[56] References Cited

U.S. PATENT DOCUMENTS

| | | | |
|---|---|---|---|
| 3,050,229 | 8/1962 | Neff | 206/626 |
| 3,853,261 | 12/1974 | Moore | 206/612 |
| 3,971,506 | 7/1976 | Roenna | 206/626 |
| 4,531,668 | 7/1985 | Forbes, Jr. | 206/612 |

*Primary Examiner*—Stephen P. Garbe

*Attorney, Agent, or Firm*—Gordon W. Hueschen

[57] ABSTRACT

There is disclosed a package formed of a carton stock having front and rear main panels, side panels, and a set of end closure flaps, which comprises dust flaps, a cover flap, and a sealing flap, and coated, at least on the end closure flap, with a heat sealing coating which is cut and scored in a manner such that the sealing flap can be pulled away from the cover flap and the cover flap broken away to open the carton. The sealing flap has a tuck-in tab and the cover flap a complementary punch-in for effecting reclosing of the package.

30 Claims, 10 Drawing Figures

RECLOSABLE PACKAGE AND CARTON BLANK AND PROCESS FOR MAKING THE SAME

This application is in part a continuation of my copending application Ser. No. 625,725, filed June 28, 1984.

BACKGROUND OF THE INVENTION

1. Field of the Invention

The invention relates to a reclosable package and a carton blank used in making the reclosable package. The invention also relates to a process of making the same from carton stock, coated at least on the end closure flaps thereof, with a heat-sealing coating.

2. Prior Art

Various types of reclosable cartons or packages formed of carton stock cut and scored to a plurality of panels and end closure flaps have heretofore been disclosed in which various means for effecting reclosing of the package are disclosed. None, however, discloses such a reclosable package in which the carton stock is coated with a heat-sealing coating, in which a unitary end closure is formed by means of the heat-sealing of the various flaps, and in which the end closure is provided with ply-separation and tear means which, when separated and torn, frees a cover flap with a tuck-in tab thereon sufficiently that it can be opened and reclosed.

Thus, U.S. Pat. No. 3,297,229, granted Jan. 10, 1967, to G. R. Bluem, discloses a gastight box having dust flaps and a closure flap and a sealing flap which were provided with appropriately located glue strips so that, when the flaps are folded in, a gastight enclosure is obtained. The closure here, however could be made reclosable only by using a tacky adhesive and does not involve any ply-separation means or tear-out means.

U.S. Pat. No. 2,925,948, granted Feb. 23, 1962, to C. R. Alden, discloses a dispensing container having a reclosable opening which has dust flaps, a cover flap and a sealing flap with a partial tear-out portion, whereby a part of the sealing flap and a part of the closure can be torn out and left hinged at its base to provide a reclosable closure. No ply-separation means is involved and no cover having a tuck-in tab is involved.

U.S. Pat. No. 2,889,977, granted June 9, 1959, to K. T. Buttery, discloses a dispensing carton having dust flaps, a cover flap and a sealing flap, in which part of the cover flap is cut away and the portion of the sealing flap overlying the cut-away portion is scored, so that it can be broken away to provide a reclosable cover. The reclosable cover, however, could not be made substantially the full size of the carton end because then there would be no inner closure flap. Moroever, there is no ply-separation means involved.

U.S. Pat. No. 4,317,518, granted Mar. 2, 1982, to Duane R. Mode, discloses a carton in which the end panel is provided with ply-separation means, whereby a pouring spout can be formed in the carton. However, there is no disclosure of a reclosable carton with the ply-separation and tear means so that, when separated and torn, a reclosable closure flap having a tuck-in tab is freed.

U.S. Pat. No. 3,438,565, granted Apr. 15, 1969, to T. V. Lugt et al., discloses a reclosable carton with a tear open spout but there is disclosed no cover flap with a tuck-in tab formed by ply-separation means and tear means.

U.S. Pat. No. 4,201,292, granted May 6, 1980, to Thomas L. Davidson et al., discloses a dispenser carton having an inner closure flap having a tear out portion and an outer closure flap having a ply-separation portion operative to provide a tuck-in tab which can be inserted into the container after the pull-out portion is removed. There is no disclosure of a closure flap having a tuck-in tab on it which is freed up sufficiently that it can be opened and reclosed when tear means in cooperation with ply-separation means are actuated.

U.S. Pat. No. 3,934,791, granted Jan. 27, 1976, to Raymond S. Dick et al., discloses a carton having a complicated end closure designed to facilitate applying adhesive, but involves no ply-separation means or tear means and, moreover, does not rely upon a heat-sealing coating to effect the end closure.

U.S. Pat. No. 4,015,768, granted Apr. 5, 1977, to Noel McLennan, discloses a sealed end carton with a reclosable pouring opening formed by an inner closure flap having a tear-out portion overlying and sealed to the tear-out portion of the inner closure flap such that, when the outer tear-out portion is torn out, the inner tear-out portion is freed and a pouring spout is formed. However, there is no closure flap having a tuck-in tab of ply-separation means and tear means which cooperate to free the cover flap.

U.S. Pat. No. 3,426,955, granted Feb. 11, 1966, to J. F. Olson, discloses a combination bag and box in which an inner closure flap has a tear-out spout forming portion underlying a portion of an outer flap which can be torn away along one side to provide a hinged closure which can be resealed over the pouring spout which is formed by the inner bag going through the tear-out opening in the inner closure. Here, too, there is no combination of ply-separation means and tear means which frees a cover flap with a tuck-in tab sufficiently that it can be opened and reclosed.

U.S. Pat. No. 3,549,082, granted Dec. 22, 1970, to Warren O. Simpson, discloses a reclosable carton having a partial cover flap and a partial sealing flap having complementary reclosable configuration but the closed end is not hermetically sealed as the glue areas 41 and 42 extend only part way across the dust flaps and there is no ply-separation means.

U.S. Pat. No. 2,151,202, granted Mar. 21, 1939, to R. Guyer, discloses a reclosable carton which has tear out means, but no ply-separation means.

U.S. Pat. No. 3,662,949, granted May 26, 1972, to Thomas W. Foster, discloses a reclosable carton with a tear out means, but no ply-separation means.

U.S. Pat. No. 3,958,748, granted May 25, 1976, to William Andrew Smith et al., discloses a reclosable carton which has tear out means, but no ply-separation means.

SUMMARY OF THE INVENTION

The invention relates to a carton blank and a package made of carton stock having front and rear main panels, side panels, and a set of end closure flaps, which comprises dust flaps, a cover flap, and a sealing flap, and coated, at least on the end closure flaps, with a heat sealing coating, and is particularly directed to the improvement in which:

said dust flaps and said cover flap have sealing areas adjacent to the fold lines thereof;

said cover flap has cut-away end portions corresponding to the sealing areas of said dust flaps so that, when they are folded in on top of the dust flaps, the dust-flap sealing areas are exposed;

said cover flap, save for the cover flap sealing area, is coated with a non-heat-sealing coating to provide a non-sealing area which, in the end of a closed carton erected therefrom, stretches from one dust-flap sealing area to the other and to the edge of the cover flap;

said sealing flap is adapted to be folded down onto the infolded dust flaps and adhered to the sealing areas thereof and to the sealing area of said cover flap;

said sealing flap has a centrally-located pull tab;

the area of the sealing flap which, in the closed end, overlies the non-sealing area of the cover flap is circumscribed by a sealing-flap ply-separation means forming a ply-separable area which extends from the sealing flap fold line along the sealing area of each dust flap and along the cover flap sealing area to said pull tab;

and said sealing flap has a line of weakness which angles in from each corner to said ply separation means.

The invention is also directed to a process for making a reclosable package which comprises:

making a carton blank of carton stock having front and rear main panels, side panels, and a set of end closure flaps, which comprises dust flaps, a cover flap, and a sealing flap, and coated, at least on the end closure flaps, with a heat sealing coating;

cutting away the ends of said cover flap to expose, when the cover flap laps the dust flaps, narrow sealing areas along the fold lines of said dust flaps;

coating the rest of said dust flaps with a non-sealing coating;

coating said cover flap with a non-sealing coating except for a narrow strip along the fold line thereof, thereby leaving a narrow sealing area which, when the cover flap laps the dust flaps, complements the dust flap sealing areas to form therewith, when the cover flap is folded in on the dust flaps, a continuous U-shaped sealing area along the fold lines of the dust flap and the cover flap;

making parallel cuts in the center portion of said sealing flap and crease-scoring across said cuts to form a pull tab of a size to overlie the corresponding center portion of said cover flap sealing area;

forming offset ply-separation scoring in said sealing flap which, in the closed end of the erected carton, coincides with the inner edges of said U-shaped sealing area; and forming lines of weakness in said sealing flap which angle in from the corners thereof to said ply-separation scoring.

The invention also comprises one or more further features both in structural and process aspects in which said cover flap sealing area has a pull-tab ply-separation means which, in the end of a closed carton erected therefrom, lies under said pull tab and is adhered thereto so that, when the pull tab is lifted, ply separation of the pull-tab ply-separation means is effected, followed by ply separation of the sealing-flap ply-separation means; in which said cover flap has a pull-tab receiving means operative, after ply separation of said sealing flap and the portions of the dust flap and cover flap adhered thereto, to form with said pull tab a reclosing means; in which said pull-tab receiving means comprises an aperture or aperture-forming means of a size, shape, and location to receive the pull tab, and to form therewith a reclosing means; in which said pull-tab receiving means comprises a punch-in portion adapted, when punched in, to form an aperture of a size, shape, and location to receive, in the erected carton, the pull tab, and to form therewith a reclosing means; in which said pull-tab ply-separation means has a ply-separation cut line partly in the fold line of the cover flap and partly in the main panel to which the cover flap is attached, whereby, when the cover flap is folded in, the portion of the ply-separation means in said main panel breaks away from said main panel and constitutes a projection, and a portion of the pull tab is shaped to overlie, in the erected carton, this projection and is adhered thereto to provide means whereby the pull tab and the underlying ply-separation means can be grasped to effect the desired ply separation by pulling up on the pull tab; in which the dust-flap sealing areas are embossed to provide a raised portion adapted to project into said cut-away portions of the cover flap; and in which the non-sealing area of the cover flap is debossed to provide a depressed portion opposed to said sealing-flap ply-separation area.

BRIEF DESCRIPTION OF THE DRAWINGS

In the drawings:

FIG. 5 is a cross section showing the tuck-in tab tucked in;

DESCRIPTION OF THE PREFERRED EMBODIMENTS

Figure 1:
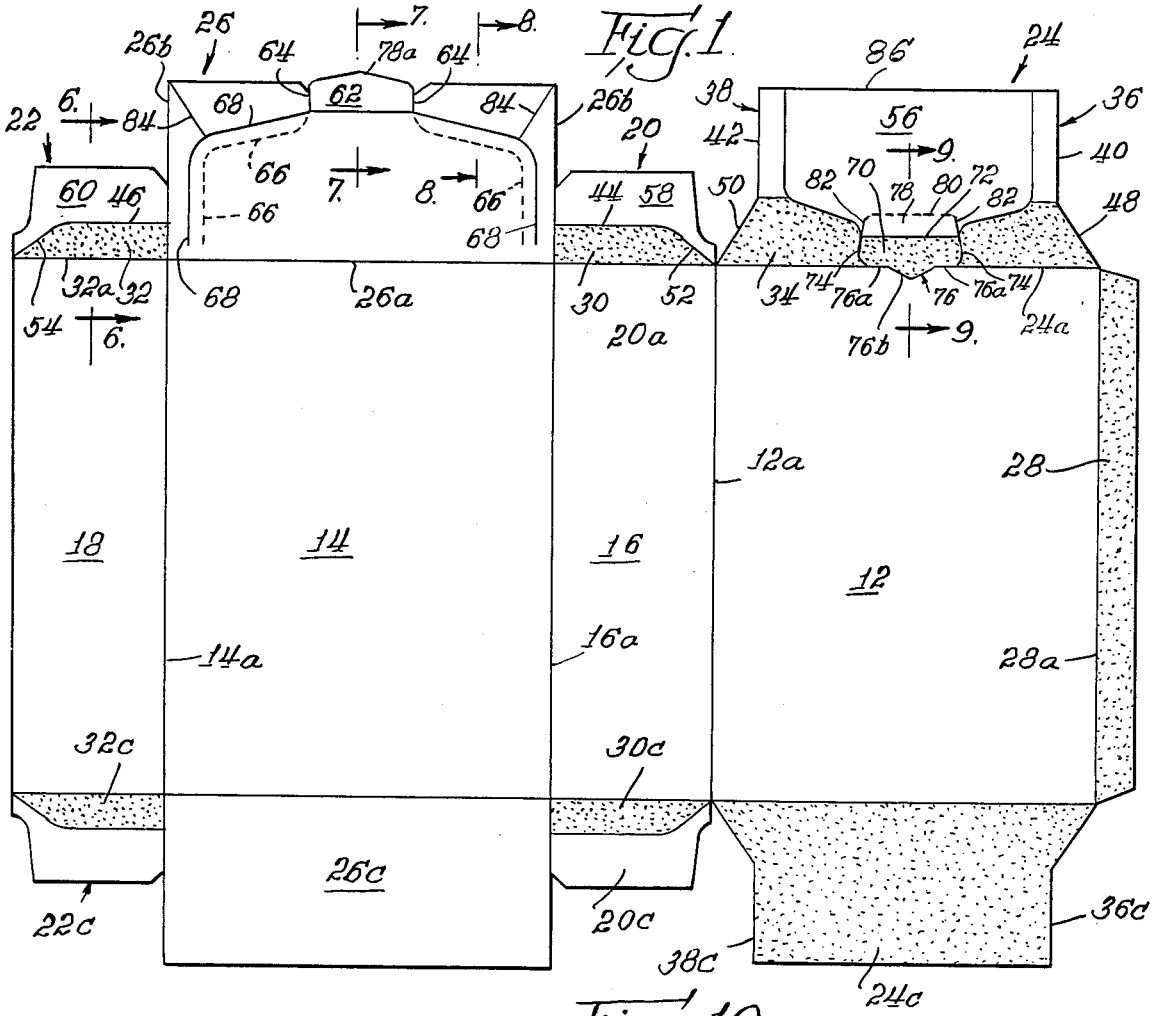
FIG. 1 is a plan view of the outside of a carton blank of the invention.
Figure 2:
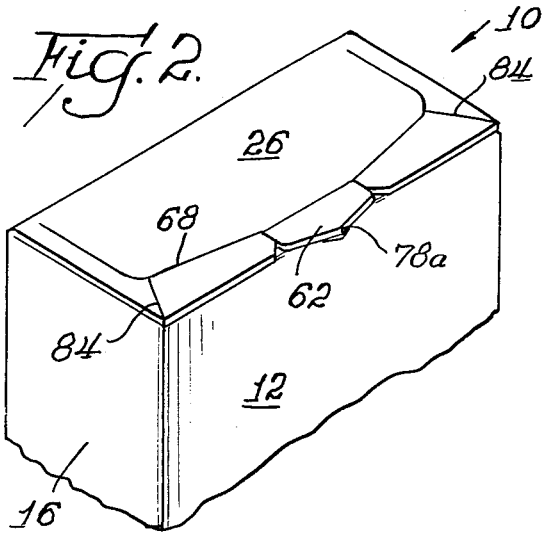
FIG. 2 is an isometric view of the closed end of a carton of the invention.

In FIG. 2, there is disclosed a carton 10 made from the carton blank of FIG. 1, made of carton stock having front and rear panels 12 and 14, side panels 16 and 18, a glue panel 28, and a set of end closure flaps comprising dust flaps 20 and 22, a cover flap 24 and a sealing flap 26. The panels are separated by fold lines 12*a*. 14*a*, 16*a*, and 28*a*, which are crease-scored with the indentation on the obverse side and the bead on the reverse side. The flaps have similar transverse score lines.

The dust flaps and cover flaps have sealing areas 30, 32, and 34 as relatively narrow strips adjacent the transverse fold lines. The cover flap 24 has its ends cut away at 36 and 38 so that the edges 40 and 42 correspond respectively to the edges 44 and 46 of the dust flap sealing areas 30 and 32.

The cut-away portions 36 and 38 angle, as shown at 48 and 50 to the corners formed by fold lines 12*a* and 28*a* and the transverse fold line 24*a*, and the sealing areas 30 and 32 have complementary slopes 52 and 54 such that, when the flaps are folded in, the cover flap 24 overlies the dust flaps 20 and 22. The sealing areas 32, 34, and 30 form a continuous U-shaped sealing area such that, when the sealing flap 26 is folded thereon and adhered thereto, a tight closure is obtained.

The sealing areas 30, 32, and 34 are formed of a sealing coating which is applied to the obverse and reverse sides the carton stock and the sealing areas are demarked by the application of varnish or like non-sealing coating to leave parts of the dust flaps 20 and 22 and the cover flap 24 extending beyond the sealing areas, as designated by the reference numerals 56, 58, and 60, free of sealing coating.

The sealing flap 26 is provided with a pull tab 62 formed by parallel cut lines 64 and is provided with inner and outer ply-separation cut lines 66 and 68 which extend from the cut lines 64 down to the fold line 26*a*.

Figure 8:
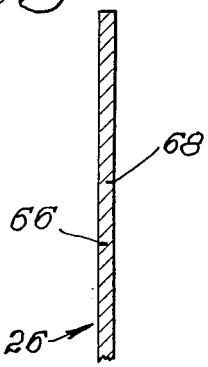
FIG. 8 is a cross section taken on line 8—8 of FIG. 1.
Figure 9:
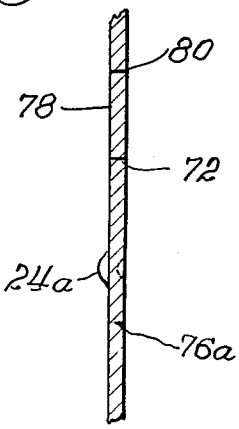
FIG. 9 is a cross section taken on line 9—9 of FIG. 1.

The cut line 66 is cut in from the obverse side and is inset from the sides 26*b* of the sealing flap 26 a distance equal to the width of the sealing areas 30 and 32, curve in at 66*a* to meet the end of the cut 64. The cut lines 66 and 68 are really half-cut or semi-cut lines which, as shown in FIG. 8, extend only part way in so that the plies between the two cut lines adjacent the obverse side stay with the obverse side, whereas the plies between the two cut lines adjacent the reverse side, stay with the reverse side when ply separation is effected.

The cover flap 24 has a ply-separation area 70 of the same general configuration as the pull tab 62 and is designed by a through-cut line 72 and ply-separation cut lines 74 and 76. The ply separation lines 76 have short portions 76*a* which are aligned in the fold line 24*a* and a V-shaped portion 76*b* which extends into panel 12. The fold line 24*a* does not extend across this V-shaped portion so that, when the cover flap 24 is folded in, ply separation takes place along the V-shaped ply separation lines 76*b* so that the V-shaped portion projects out beyond the panel 12. The pull tab 62 has a complementary V-shaped portion which overlaps and is adhered to the V-shaped portion 76*b*.

In cover flap 24 there is provided a cut configuration 78 which provides an aperture of a size and shape to received the pull tab 62 so that the closure can be reclosed by inserting the pull tab in that aperture. The push-in member 78 is bounded by perforated line 80 and lines 72 and 82 which are cut lines, and will give away when the area 78 is pushed in.

Figure 4:
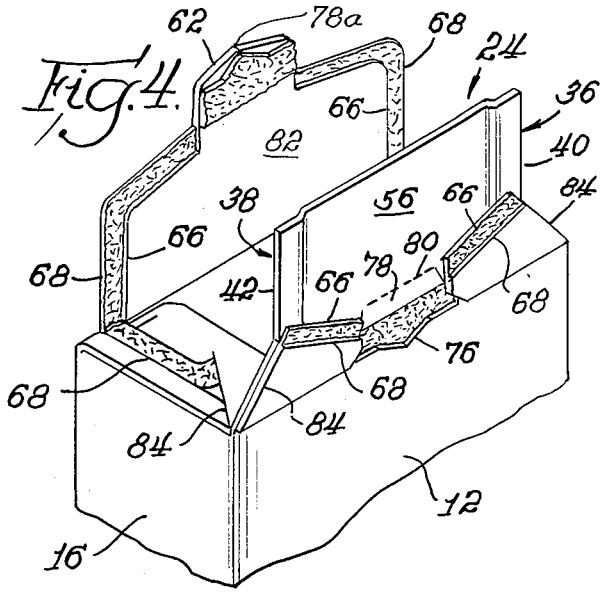
FIG. 4 is an isometric view corresponding to FIG. 3 with the cover flap pulled free.
Figure 6:
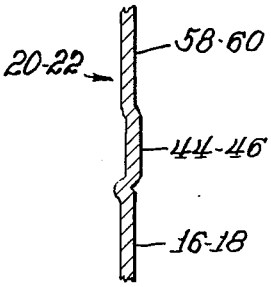
FIG. 6 is a cross section taken on line 6—6 of FIG. 1.

In order to effect a closer and tighter seal between the sealing flap and the dust flaps, sealing strips 44 and 46, as is shown in FIG. 6, the portions 58–60 are debossed so that the sealing strips 44–46 are raised up into the cut-away portions of the cover flap. Another way of putting it is that the sealing strips 44–56 are embossed. Also, the central portion 56 of the cover flap is debossed, as shown at FIG. 4, to provide a depressed area which will not be in contact with the sealing flap during the sealing operation. While no sealing should take place because of the varnish which is on this portion of the sealing flap, the debossing is an added precaution against such sealing taking place.

The bottom end closure is formed by dust flaps, a cover flap and a sealing flap sealed together in the manner described above but without the provisions for a resealable closure. Similar parts to the top flaps are suffixed with a "c".

In forming the closed end shown in FIG. 2, the dust flaps 20 and 22 are folded in, then the cover flap 24 is folded in on top of the dust flaps with the edges 40 and 42 in alignment with the edges 44 and 46 of the sealing areas of the dust flap. Thus, the sealing areas 30, 32, and 34 form a continuous U-shaped sealing area which extends down along fold line 20*a* to fold line 24*a* and then up along fold line 32*a*. The sealing flap is then folded down on the folded-in dust flaps and cover flap and adhered thereto on the U-shaped sealing area. If desired, the areas of the reverse side of the sealing flaps which are not opposed to sealing areas 30, 32, and 34 can be coated with varnish, but this ordinarily is not necessary. During the opening of the package, the projection 78*a* is grasped and the pull tab pulled up to the position shown in FIG. 3, thus forming a new reclosable cover 82. The pull tab 62 is provided with a crease-score line 62*a* so that the tab can be bent and inserted in the hold formed by pushing in the area 78, as shown in FIG. 5.

Figure 3:
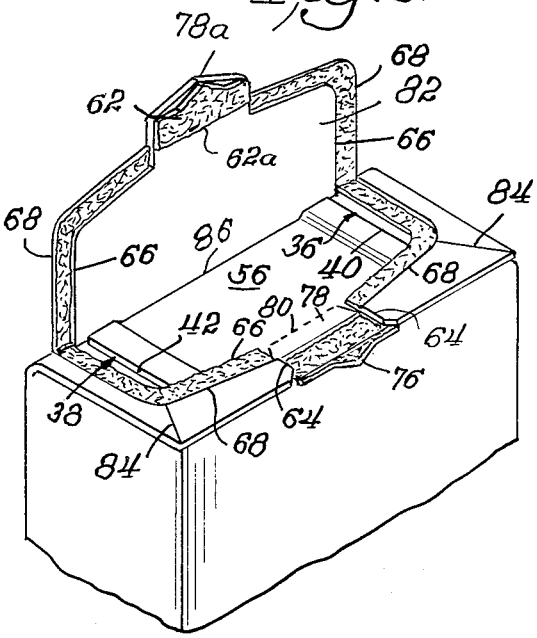
FIG. 3 is an isometric view corresponding to FIG. 2 with the sealing flap pulled free.

The package is then opened, as shown in FIG. 4. This is made possible by the lines of weakness 84 which extends from the corners of the package angularly to intersect the ply-separation cut line 68 adjacent the point where it changes direction from being parallel to the edges of the sealing flap to where it begins to slope up to the cut lines 64. By grasping the edge 86 of the cover flap, as shown in FIG. 3, and pulling up, the lines of weakness 84, or tear lines, as they may be called, are broken away and which was originally a cover flap, now is an inner flap which, to effect reclosure, is folded in so that the area 78 is in position to receive the pull tab 62.

Figure 5:
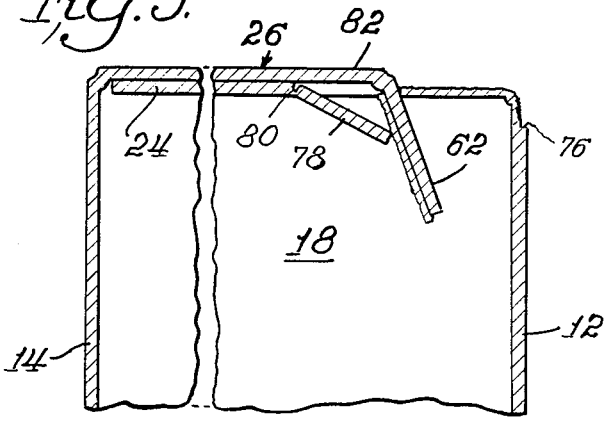
Figure 7:
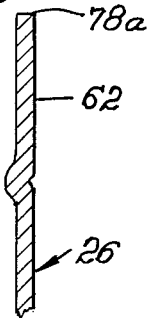
FIG. 7 is a cross section taken on line 7—7 of FIG. 1.

FIG. 7 shows a typical crease-score which is used for the pull tab 62 and gives it a resiliency to hold the resealing cover 82 in place, as shown in FIG. 5.

In FIG. 1, the ends of the sealing areas 30 and 32 are cut on angles 52 and 54 which are complementary with the angles 48 and 50 of the sealing areas 34 of the cover flap 24. Thus, both angles can be 45 degrees. Then, when the flaps are folded down, this provides for a continuous U-shaped glue area as described above.

Figure 10:
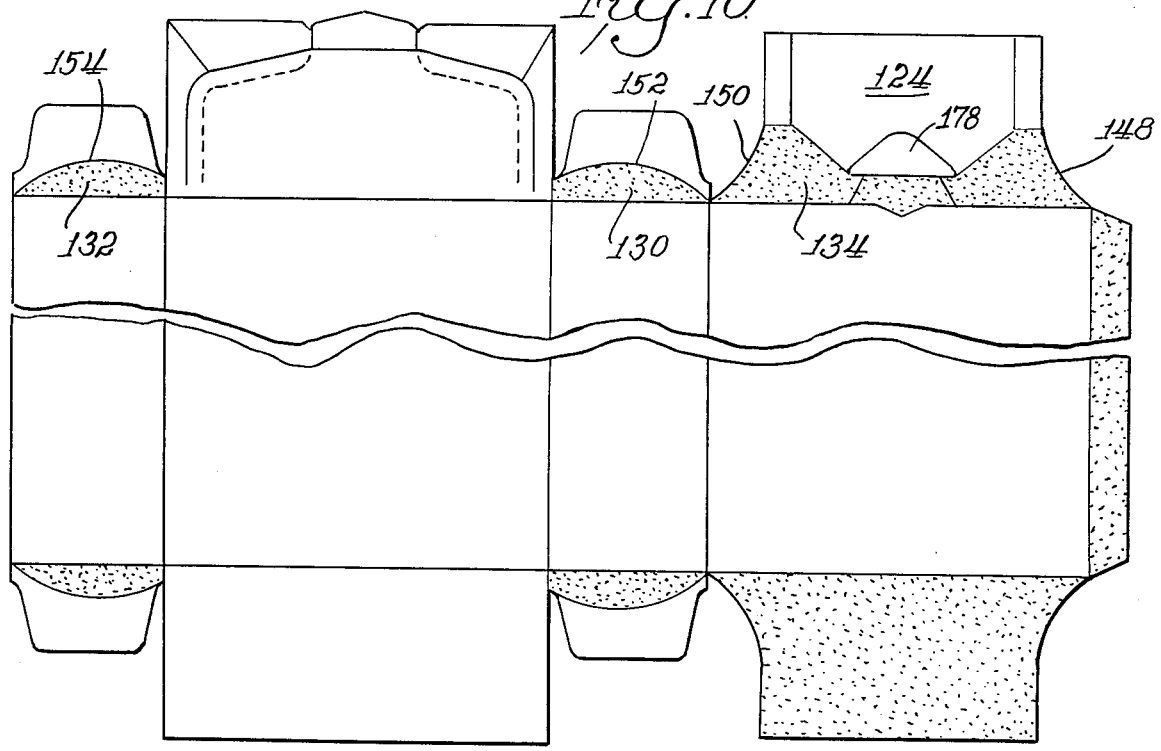
FIG. 10 is a plan view of a modified form of a carton blank of the invention.

In the modification shown in FIG. 11, the glue areas 130 and 132 are arcuate, as shown at 152 and 154 which are complementary with the arcuate edges 148 and 150 of the glue area 134 of the cover flap 124. In this modification, there is shown a cut out 178 instead of the cut configuration aperture-forming member 78. Otherwise, the construction in FIG. 10 is the same as in FIG. 1.

There is thus provided a carton which can be hermetically sealed or at least sealed tight enough to keep out insects and vermin, which is easily opened and which is easily resealed.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. In a carton blank made of carton stock having front and rear main panels, side panels articulated by fold lines to a set of end closure flaps, which comprises dust flaps, a cover flap, and a sealing flap, and coated, at least on the end closure flaps, with a heat sealing coating:

the improvement in which:

said dust flaps and said cover flap have sealing areas adjacent to the fold lines thereof;

said cover flap has cut-away end portions corresponding to the sealing areas of said dust flaps so that, when they are folded in on top of the dust flaps, the dust-flap sealing areas are exposed;

said cover flap, save for said cover flap sealing area, is coated with a non-heat-sealing coating to provide a non-sealing area which, in the end of a closed carton erected therefrom, stretches from one cut-away portion to the other and to the edge of the cover flap;

said sealing flap is adapted to be folded down onto the infolded dust flaps and adhered to the sealing areas thereof and to the sealing area of said cover flap;

said sealing flap has a centrally-located pull tab;

an area of the sealing flap which, in the closed end, overlies the non-sealing area of the cover flap is circumscribed by a sealing-flap ply-separation means forming a ply-separable area which extends from the sealing flap fold line along the sealing area of each dust flap and along the cover flap sealing area to said pull tab;

and said sealing flap has a line of weakness which angles in from each corner to said ply separation means.

2. A carton blank of claim 1, in which said cover flap sealing area has a pull-tab ply-separation means which is complementery with said pull tab and is adapted to be adhered thereto.

3. A carton blank of claim 2, in which said cover flap has a pull-tab receiving means complementary with and adapted to receive said pull tab.

4. A carton blank of claim 3, in which said pull-tab receiving means comprises an aperture or aperture-forming means of a size, shape, and location complementary with and adapted to receive the pull tab, and to form therewith a reclosing means.

5. A carton blank of claim 3, in which said pull-tab receiving means comprises a punch-in portion adapted, when punched in, to form an aperture of a size, shape, and location complementary with and adapted to receive the pull tab, and to form therewith a reclosing means.

6. A carton blank of claim 2, in which said pull-tab ply-separation means has a ply-separation cut line partly in the fold line of the cover flap and partly in the main panel to which the cover flap is attached, whereby, when the cover flap is folded in, the portion of the ply-separation means in said main panel breaks away from said main panel and constitutes a projection complementary with said pull tab and adapted to be adhered thereto to provide means whereby the pull tab and the underlying ply-separation means can be grasped to effect the desired ply separation by pulling up on the pull tab.

7. A carton blank of claim 6, in which the dust-flap sealing areas are embossed to provide a raised portion adapted to project into said cut-away portions of the cover flap and in which the non-sealing area of the cover flap is debossed to provide a depressed portion complementary to said sealing-flap ply-separation area.

8. A carton blank of claim 2, in which the dust-flap sealing areas are embossed to provide a raised portion adapted to project into said cut-away portions of the cover flap.

9. A carton blank of claim 8, in which the non-sealing area of the cover flap is debossed to provide a depressed portion complementary to said sealing-flap ply-separation area.

10. A carton blank of claim 2, in which the non-sealing area of the cover flap is debossed to provide a depressed portion complementary to said sealing-flap ply-separation area.

11. A package of claim 2, in which said pull-tab ply-separation means has a ply-separation cut line partly in the fold line of the cover flap and partly in the main panel to which the cover flap is attached, whereby the portion of the ply-separation means in said main panel is broken away from the main panel and constitutes a projection, and a portion of the pull tab is shaped to overlie this projection and is adhered thereto to provide means whereby the pull tab and the underlying ply-separation means can be grasped to effect the desired ply separation by pulling up on the pull tab.

12. A package of claim 2, in which the non-sealing area of the cover flap is debossed to provide a depressed portion opposed to said sealing-flap ply-separation area.

13. A package of claim 2, in which said pull-tab ply-separation means has a ply-separation cut line partly in the fold line of the cover flap and partly in the main panel to which the cover flap is attached, whereby the portion of the ply-separation means in said main panel is broken away from the main panel and constitutes a projection, and a portion of the pull tab is shaped to overlie this projection and is adhered thereto to provide means whereby the pull tab and the underlying ply-separation means can be grasped to effect the desired ply separation by pulling up on the pull tab, and in which the non-sealing area of the cover flap is debossed to provide a depressed portion opposed to said sealing-flap ply-separation area.

14. A package of claim 2, in which the dust-flap sealing areas are embossed to provide a raised portion which projects into said cut-away portions of the cover flap.

15. A package of claim 14, in which the non-sealing area of the cover flap is debossed to provide a depressed portion opposed to said sealing-flap ply-separation area.

16. In a package made of carton stock having front and rear main panels, side panels articulated by fold lines to a set of end closure flaps, which comprises dust flaps, a cover flap, and a sealing flap, and coated, at least on the end closure flaps, with a heat sealing coating;

the improvement in which:

said dust flaps and said cover flap have sealing areas adjacent to the fold lines thereof;

said cover flap has cut-away end portions corresponding to the sealing areas of said dust flaps so that, when they are folded in on top of the dust flaps, the dust-flap sealing areas are exposed;

said cover flap, save for said cover flap sealing area, is coated with a non-heat-sealing coating to provide a non-sealing area which stretches from one dust-flap sealing area to the other and to the edge of the cover flap;

said sealing flap is folded down onto the infolded dust flaps and adhered to the sealing areas thereof and to the sealing area of said cover flap;

the area of the sealing flap which overlies the non-sealing area of the cover flap is circumscribed by a sealing-flap ply-separation means forming a ply-separable area which extends from the sealing flap fold line along the sealing area of each dust flap and along the cover flap sealing area to said pull tab;

and said sealing flap has a line of weakness which angles in from each corner to said ply separation means.

17. A package of claim 16, in which said cover flap sealing area has a pull-tab ply-separation means which lies under said pull tab and is adhered thereto so that, when the pull tab is lifted, ply separation of the pull-tab ply-separation means is effected followed by ply separation of the sealing-flap ply-separation means.

18. A package of claim 17, in which said cover flap has a pull-tab receiving means operative, after ply separation of said sealing flap and the portions of the dust flap and cover flap adhered thereto, to form with said pull tab a reclosing means.

19. A package of claim 18, in which said pull-tab receiving means comprises an aperture or aperture-forming means of a size, shape, and location to receive the pull tab, and to form therewith a reclosing means.

20. A package of claim 18, in which said pull-tab receiving means comprises a punch-in portion adapted, when punched in, to form an aperture of a size, shape, and location to receive the pull tab, and to form therewith a reclosing means.

21. A process for making a reclosable package which comprises:

making a carton blank of carton stock having front and rear main panels, side panels articulated by fold lines to a set of end closure flaps, which comprises dust flaps, a cover flap, and a sealing flap, and coated, at least on the end closure flaps, with a heat sealing coating;

cutting away the ends of said cover flap to expose, when the cover flap laps the dust flaps, narrow sealing areas along the fold lines of said dust flap;

coating the rest of said dust flaps with a non-sealing coating;

coating said cover flap with a non-sealing coating except for a narrow strip along the fold line thereof, thereby leaving a narrow sealing area which, when the cover flap laps the dust flaps, complements the dust flap sealing areas to form therewith, when the cover flap is folded in on the dust flaps, a continuous U-shaped sealing area along the fold lines of the dust flap and the cover flap;

making parallel cuts in the center portion of said sealing flap and crease-scoring across said cuts to form a pull tab of a size to overlie the corresponding center portion of said cover flap sealing area;

forming offset ply-separation scoring in said sealing flap which, in the closed end of the erected carton coincides with the inner edges of said U-shaped sealing area; and forming lines of weakness in said sealing flap which angle in from the corners thereof to said ply-separation scoring.

22. A process of claim 21, which further comprises ply-separation scoring said corresponding center portion so that when the pull tab is adhered thereto and pulled, surface plies of said corresponding center portion will tear away with the pull tab with ply separation in said cover flap.

23. A process of claim 22, which further comprises forming pull-tab receiving means in said cover flap operative, after ply separation of said sealing flap and the portions of the dust flap and cover flap adhered thereto, to form with said pull tab a reclosing means.

24. A process of claim 23, in which said pull-tab receiving means comprises an aperture or aperture-forming means of a size, shape, and location to receive the pull tab, and to form therewith a reclosing means.

25. A process of claim 23, in which said pull-tab receiving means comprises a punch-in portion adapted, when punched in, to form an aperture of a size, shape, and location to receive the pull tab, and to form therewith a reclosing means.

26. A process of claim 22, in which the ply-separation scoring is effected partly in the fold line of the cover flap and partly in the main panel to which the cover flap is attached, whereby, when the cover flap is folded in, the portion of the ply-separation means in said main panel breaks away from said main panel and constitutes a projection, and shaping a portion of the pull tab to overlie this projection and causing it to be adhered thereto to provide means whereby the pull tab and the underlying ply-separation means can be grasped to effect the desired ply separation by pulling up on the pull tab.

27. A process of claim 26, which further comprises embossing the dust-flap sealing areas to provide a raised portion to project into said cut-away portions of the cover flap, and debossing the non-sealing area of the cover flap to provide a depressed portion opposed to said sealing-flap ply-separation area.

28. A process of claim 22, which further comprises debossing the non-sealing area of the cover flap to provide a depressed portion opposed to said sealing-flap ply-separation area.

29. A process of claim 22 which further comprises embossing the dust-flap sealing areas to provide a raised portion to project into said cut-away portions of the cover flap.

30. A process of claim 29, which further comprises debossing the non-sealing area of the cover flap to provide a depressed portion opposed to said sealing-flap ply-separation area.

* * * * *

UNITED STATES PATENT AND TRADEMARK OFFICE

CERTIFICATE OF CORRECTION

PATENT NO. : 4,577,762

DATED : March 25, 1986

INVENTOR(S) : Morris W. Kuchenbecker

It is certified that error appears in the above-identified patent and that said Letters Patent is hereby corrected as shown below:

Title Page, between item [22] and item [51]; insert this item --
-- [63] Related U.S. Application Data
Continuation in part of Serial No. 625,725, June 28, 1984 --

Title Page, References Cited, U.S. PATENT DOCUMENTS; insert these patent documents after the last patent document;

| | | | |
|---|---|---|---|
| -- | 2,151,202 | 3/39 | R. Guyer |
| | 2,889,977 | 6/59 | K. T. Buttery |
| | 2,925,948 | 2/62 | C. R. Alden |
| | 3,297,229 | 1/67 | G. R. Bluem |
| | 3,426,955 | 2/69 | J. F. Olson |
| | 3,438,565 | 4/69 | T. Vander Lugt et al. |
| | 3,549,082 | 12/70 | Warren O. Simpson |
| | 3,662,945 | 5/72 | Thomas W. Foster |
| | 3,934,791 | 1/76 | Raymond S. Dick, et al. |
| | 3,958,748 | 5/76 | William Andrew Smith, et al. |
| | 4,015,768 | 4/77 | Noel McLennan |
| | 4,201,292 | 5/80 | Thomas L. Davidson, et al. |
| | 4,317,518 | 3/82 | Duane R. Mode -- |

UNITED STATES PATENT AND TRADEMARK OFFICE

CERTIFICATE OF CORRECTION

PATENT NO. : 4,577,762 Page 2 of 3

DATED : March 25, 1986

INVENTOR(S) : Morris W. Kuchenbecker

It is certified that error appears in the above—identified patent and that said Letters Patent is hereby corrected as shown below:

Col. 1, line 65; "V." should read -- Vander -- (List of Prior Art Cited by Applicant, dated 9/18/85)
Col. 2, line 24; "of" should read -- or --
Col. 2, line 27; "1966" should read -- 1969 -- (original patent)
Col. 2, line 49; "3,662,949" should read -- 3,662,945 -- (original patent)
Col. 2, line 49; "26" should read -- 16 -- (original patent)
Col. 5, line 36; "received" should read -- receive --
Col. 7, line 19; "complementery" should read -- complementary --
Col. 10, line 40; insert a comma -- , -- after "22"
Title Page, the drawing; and on Sheet 2 of the drawings, FIG. 4; (on the left-hand side of the drawing, just above the lower number 68 there is a line without a number, the number should be -- 58 -- as shown here on the right)

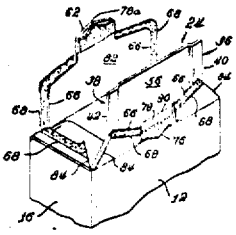

should read

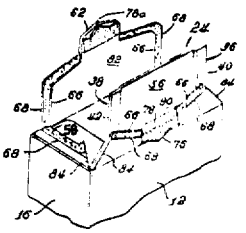

The title page should be deleted to appear as per attached page.

Signed and Sealed this

Twenty-sixth Day of August 1986

[SEAL]

Attest:

DONALD J. QUIGG

Attesting Officer

Commissioner of Patents and Trademarks

United States Patent [19]

Kuchenbecker

[11] Patent Number: 4,577,762

[45] Date of Patent: Mar. 25, 1986

[54] RECLOSABLE PACKAGE AND CARTON BLANK AND PROCESS FOR MAKING THE SAME

[75] Inventor: Morris W. Kuchenbecker, Neenah, Wis.

[73] Assignee: James River Corporation of Virginia, Richmond, Va.

[21] Appl. No.: 749,886

[22] Filed: Jun. 27, 1985

[51] Int. Cl.[4] ..... B65D 5/54

[52] U.S. Cl. ..... 206/612; 206/626; 493/58; 493/59; 493/148

[58] Field of Search ..... 206/612, 625, 626, 629; 493/58, 59, 148

[56] References Cited

U.S. PATENT DOCUMENTS

| | | | |
|---|---|---|---|
| 3,050,229 | 8/1962 | Neff | 206/626 |
| 3,853,261 | 12/1974 | Moore | 206/612 |
| 3,971,506 | 7/1976 | Roenna | 206/626 |
| 4,531,668 | 7/1985 | Forbes, Jr. | 206/612 |

*Primary Examiner*—Stephen P. Garbe

*Attorney, Agent, or Firm*—Gordon W. Hueschen

[57] ABSTRACT

There is disclosed a package formed of a carton stock having front and rear main panels, side panels, and a set of end closure flaps, which comprises dust flaps, a cover flap, and a sealing flap, and coated, at least on the end closure flap, with a heat sealing coating which is cut and scored in a manner such that the sealing flap can be pulled away from the cover flap and the cover flap broken away to open the carton. The sealing flap has a tuck-in tab and the cover flap a complementary punch-in for effecting reclosing of the package.

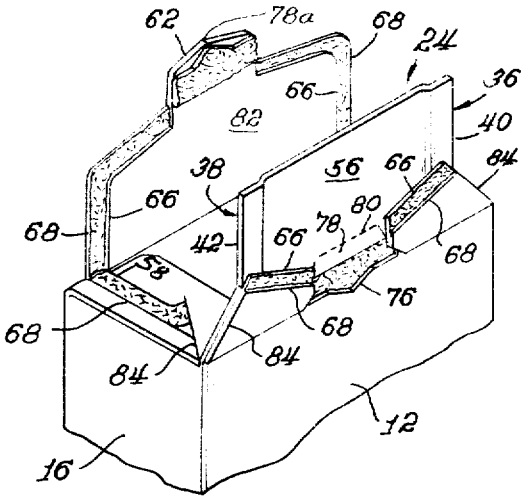

30 Claims, 10 Drawing Figures